United States Patent [19]

de Boer

[11] Patent Number: 4,521,053

[45] Date of Patent: Jun. 4, 1985

[54] CHAIR

[75] Inventor: Peter de Boer, SV Bussum, Netherlands

[73] Assignee: Gispen+Staalmeubel B.V., Culemborg, Netherlands

[21] Appl. No.: 389,037

[22] Filed: Jun. 16, 1982

[51] Int. Cl.[3] ..... A47C 1/022

[52] U.S. Cl. ..... 297/312; 297/313; 297/355

[58] Field of Search ..... 297/354, 312, 333, 345, 297/316, 355, 313, 340; 248/404

[56] References Cited

U.S. PATENT DOCUMENTS

| | | | |
|---|---|---|---|
| 1,836,630 | 12/1931 | Thum | 297/312 |
| 3,057,660 | 10/1962 | Schneider | 297/312 |
| 3,301,520 | 1/1967 | Barth et al. | 297/333 |
| 3,446,532 | 5/1969 | Cramer | 297/312 |
| 3,712,666 | 1/1973 | Stoll | 297/313 |
| 3,989,297 | 11/1976 | Kerstuolt | 297/355 |
| 4,007,962 | 2/1977 | Müller | 297/355 |
| 4,200,332 | 4/1980 | Bräuning | 297/355 |
| 4,364,605 | 12/1982 | Meiller | 297/354 |

FOREIGN PATENT DOCUMENTS

| | | | |
|---|---|---|---|
| 1550068 | 11/1968 | France | 297/340 |
| 192939 | 3/1964 | Sweden | 297/333 |
| 1161464 | 8/1969 | United Kingdom . | |

*Primary Examiner*—William E. Lyddane
*Assistant Examiner*—Mark W. Binder
*Attorney, Agent, or Firm*—Diller, Ramik & Wight

[57] ABSTRACT

A chair comprising a supporting element adapted to tilt about a horizontal axis can be constructed in an ergometrically acceptable way when the supporting element is coupled with the frame through both a torsional spring and a gas spring. In this manner the supporting element can be simply set in the correct position.

11 Claims, 7 Drawing Figures

CHAIR

Figure 7:
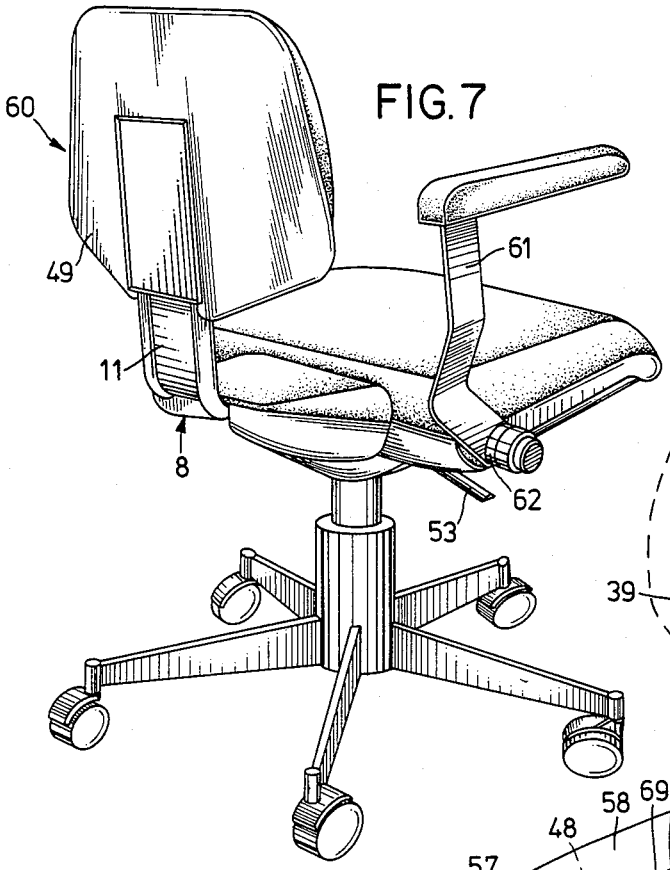

The invention relates to a chair comprising a frame and a supporting element which is tiltable about a horizontal axis with respect to said frame.

Such a chair is known.

The invention provides an improved chair in an ergometric respect, which can be simply set in the correct position because the supporting element is coupled with the frame through both a torsional spring and a gas spring.

In order to match the person's weight the chair is characterized by setting means for setting the bias tension of the torsional spring.

Preferably the gas spring is provided with two fluid chambers communicating with one another by a controllable valve.

When the supporting element comprises a back and when it is tiltable about the horizontal axis independently of the position of the front part of the seat, the position of the supporting element is better fixed.

A satisfactory, unconstrained position of the body is obtained when the horizontal axis is located slightly in front of the seat-bone knobs of an adult sitting on the chair.

The back in particular tilts in an ergometrically correct manner when the horizontal axis is at a distance of about 24 cms from the front edge of the seat, that is to say, about 24 cms behind the front edge of the seat. In this case the line of turn of the hips, the horizontal axis and the back plane remain substantially in a common plane irrespective of the tilting movement of the upper body about the line of turn of the hips. A satisfactory seat is obtained, when the seat comprises a seat element for supporting the thigh-bones, which element can turn about a horizontal axis as far as in a positive sloping position and, in particular, when the seat element is coupled with the frame through a gas spring, which comprises at least two fluid chambers communicating with one another through a controllable valve.

Figure 1:
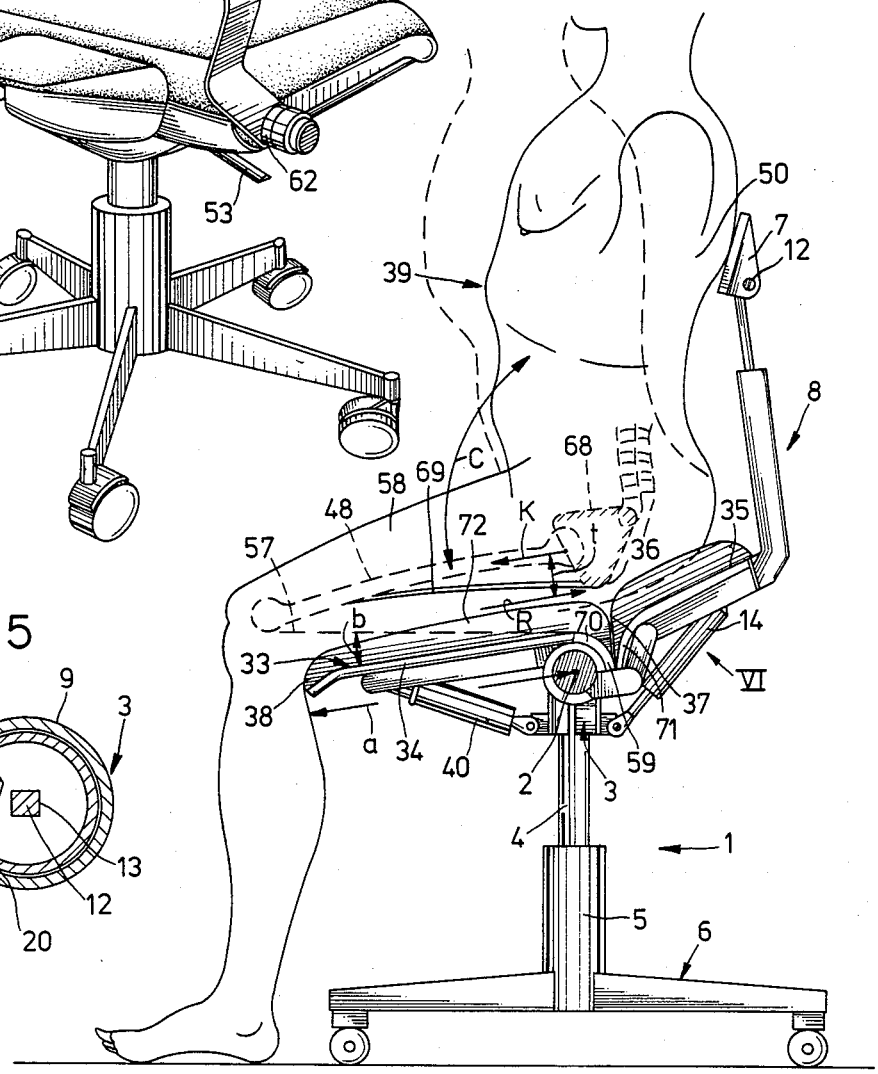
Figure 5:
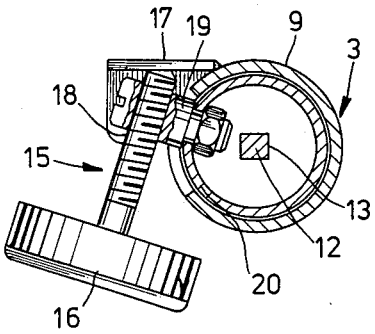
Figure 6:
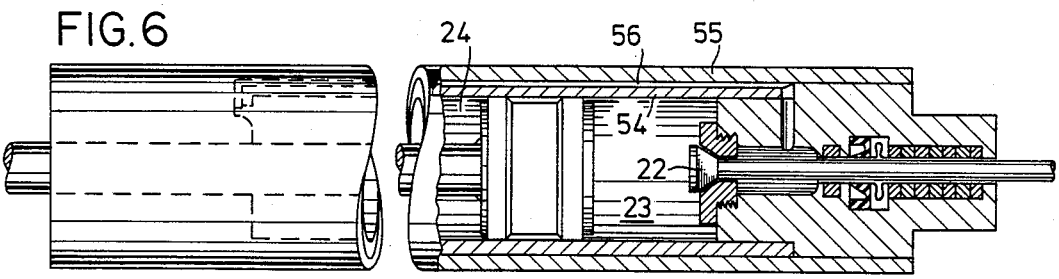
Figure 3:
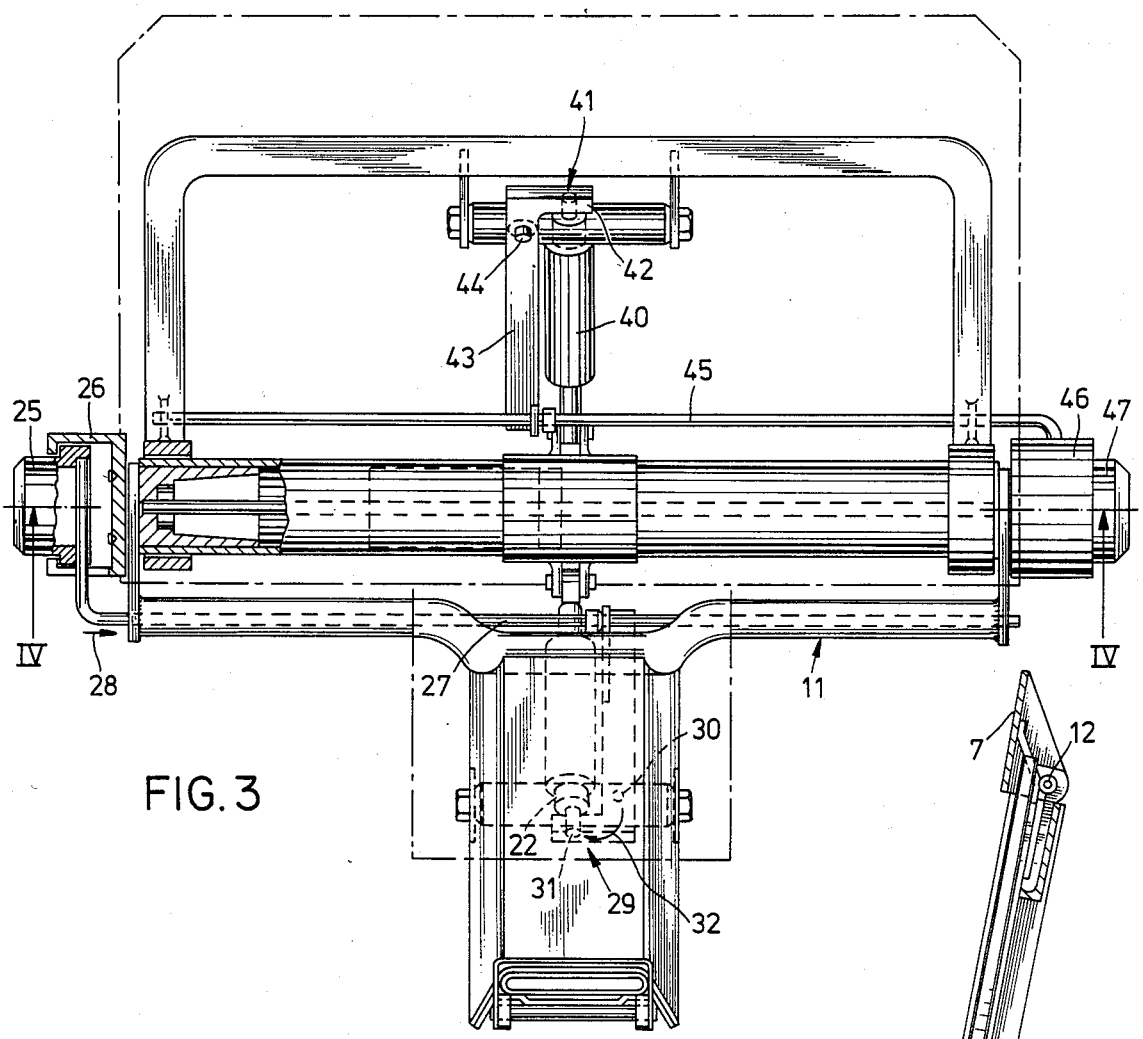
Figure 2:
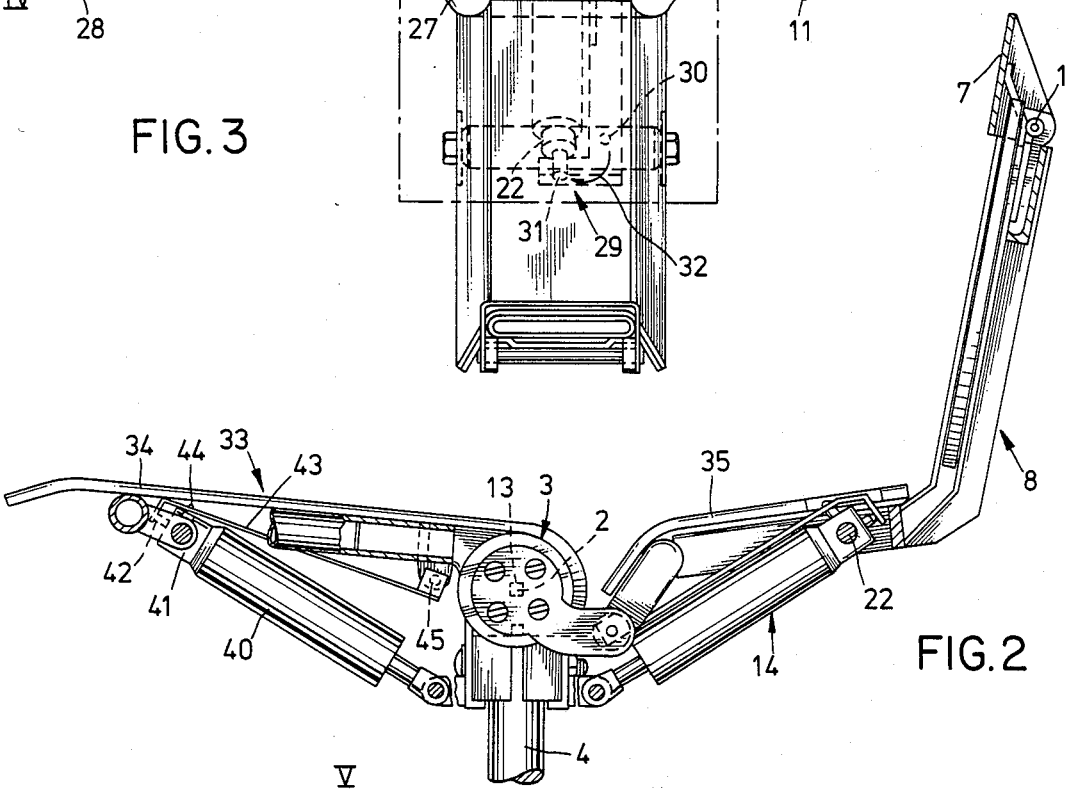
Figure 4:
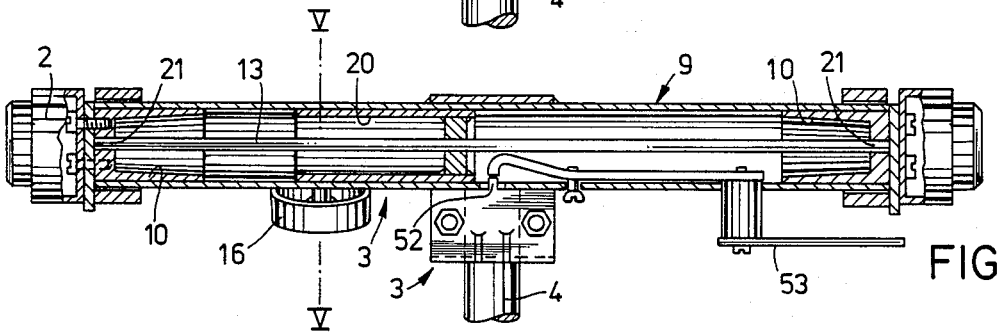

The invention will be described more fully hereinafter with reference to a drawing:

The drawing shows in:

FIG. 1 a side elevation of a chair embodying the invention with an adult sitting in it, FIG. 2 an enlarged, fragmentary side elevation of the top part of the chair of FIG. 1, FIG. 3 a fragmentary plan view of FIG. 2, FIG. 4 a sectional view taken on the line IV—IV in FIG. 3, FIG. 5 an enlarged sectional view taken on the line V—V in FIG. 4, FIG. 6 an enlarged, fragmentary elevational view of detail VI of FIG. 1 and FIG. 7 a perspective view of a further chair embodying the invention.

The chair 1 of FIG. 1 comprises a frame 3, which bears through a gas spring 4 on a column 5 of a five-leg roller set 6. The chair 1 has a seat 33 of a front part 34 and a rear part 35.

A supporting element 8 comprising a back 7 is tiltable with respect to the frame 3 about a horizontal axis 2, the frame 3 comprising a tubing 9 coaxial with the horizontal axis 2, in which two bearing elements 10 are rotatably journalled. These bearing elements 10 are screwed to a fork-shaped frame 11 of the supporting element 8. At its top end the frame 11 is connected with the back 7 by means of a hinge 12. The supporting element 8 is coupled with the frame 3 through both a torsional spring 13 and a gas spring 14.

Referring to FIG. 5, the bias tension of the torsional spring 13 is adjustable by adjusting means 15 formed by a manually operable set screw 16, which bears on an extension 17 of the tubing 9 and which extends through a tapped hole 18 of an arm 19 of a spring holder 20. The spring holder 20 is rotatably journalled in the tubing 9 and is not rotatably connected with the middle portion of the torsional spring 13. The ends of a torsional spring 13 formed in the shape of a square-section profile bar extend each in a square fitting hole 21 of a bearing element 10. Thus the torsional spring 13 drives the supporting element 8 by the set bias tension forward to tilt about the horizontal axis 2, with which the torsional spring 13 is coaxial. This tilting movement is furthermore influenced by the gas spring 14. A displacement of the supporting element 8 is possible because in the open position of the valve 22 (FIG. 6) gas flow between two chambers 23 and 24 which communicate with one another through the valve 22 and a channel 56 provided between an inner cylinder 54 and an outer cylinder 55. The valve 22 can be actuated, that is to say, opened by means of a push-button 25, which is slidable in a direction coaxial with the horizontal axis 2 in a housing 26 fastened to the frame 11. The push-button 25 actuates a sliding rod 27 in the direction of the arrow 28 and thus causes a cantilever 29 to tilt in the direction of the arrow 32 about a shaft 30 so that the control-member 31 of the valve 22 is depressed and the valve 22 is opened. Then the supporting element 8 can be displaced about the horizontal axis 2 independently of the position of the front part 34 of the seat 33. The seat 33 has a division 37 below the seat-bone knobs 36. The front edge 38 of the front part 34 is located at a distance a of about 24 cms from the horizontal axis 2 so that this horizontal axis 2 is located slightly in front of the seat-bone knobs 36 of an adult 39 sitting in normal position on the chair 1.

The front part 34, which is coupled through a gas spring 40 with the frame 3, is tiltable about the horizontal axis 2 and can be in a positive angle of inclination b about the horizontal plane 57 so that the thighs 58 of the active, forward bent adult 29 are in the most natural downward position shown in FIG. 1. The front part 34 has a curve 70 about the tubing 9 and is separated from the rear part 35 rigidly secured to the supporting element 8. The rear part 35 has at the front a curve 71 bounding a recess 37 with the curve 70. This recess 37 comfortably receives the seat-bone knobs 36 penetrating into the upholstery 72 of soft material provided on the seat 33. This recess 37 prevents the adult 39 from sliding off when the front part 34 is at a positive sloping angle b. The seat-bone knobs 36, so to say, hook behind the curve 70.

At a positive angle of inclination b the adult 39 tends to slide forward off the front part 34. This is due to a shear force K acting on the pelvis 68 in the direction of the thighs 48 and having a reactive force R exerted by the recess 37 on the seat-bone knobs 36. Thus a tilting moment $K \times t$ is exerted on the pelvis 68, which is thus tilted in a favourable position facilitating an active sitting position. Owing to the larger angle c between the thighs 48 and the trunk 50 at a positive angle of inclination b, to a reduced stress of the ischiocrurales muscular group 69 between the thighs 48 and the seat-bone knobs 36 and to the tilting moment $K \times t$ the pelvis 68 will be in a more favourable position and facilitate sitting upright. Back complaints are thus avoided.

The two fluid chambers of the gas spring 40 corresponding with the gas spring 14 communicate with one another through a valve 41, the control-member 42 is actuated for opening the valve 41 through a cantilever 43 turning about a shaft 44 and being displaceable by means of a sliding rod 45 and a push-button 47 displaceable in a housing 46.

The gas spring 4 also has two fluid chambers communicating with one another through a valve, the control member 52 of which is actuated by means of a manually operable lever 53.

The round housings 26 and 46 can be replaced by identical housings 62 with integrally moulded elbow-rests 61 of, for example, a synthetic resin, as is shown for the chair 60 of FIG. 7. The supporting element 8 may have an upwardly adjustable back 49, which may or may not be tiltable with respect to the frame 11. Said gas springs can be operative with a high pressure of, for example, 500 Newton and then have smaller dimensions.

I claim:

1. A chair having a supporting frame and a seat and back-supporting assembly supported by said frame, said seat and back-supporting assembly comprising two independently movable sections, one of which is a forward seat portion having a forward margin and the other of which is a generally L-shaped portion defining a rearward seat portion and a back-supporting portion, said forward seat portion having a rearward margin and said rearward seat portion having a forward margin and such margins being disposed in spaced relation to define depression means disposed substantially closer to said back-supporting portion than to said forward margin of the forward seat portion for receiving and locating the pelvic region of a sitting user, means for independently pivoting said seat portions to allow relative flapping motions thereof about a region adjacent said depression means, first means reacting between said forward seat portion and said frame for adjusting the angularity of said forward seat portion relative to said rearward seat portion, and second means reacting between said rearward seat portion and said frame for adjusting the angularity of said rearward seat portion relative to said forward seat portion.

2. A chair as defined in claim 1 wherein said margins of the seat portions defining said depression means are downwardly directed to define a downwardly converging gap therebetween.

3. A chair as defined in claim 1 wherein said seat portions are pivoted about a common axis located just forward of the rear margin of said forward seat portion.

4. A chair as defined in claim 3 wherein said forward seat portion has a downwardly angled front margin terminating in a front edge, said front edge being disposed about 24 cms forwardly of said common axis.

5. A chair as defined in claim 4 wherein said first means comprises a gas spring and said second means comprises the combination of a gas spring connecting said rearward portion to said frame and a torsion bar which extends along said common axis and also connects said rearward portion to said frame.

6. A chair comprising a supporting frame, a generally horizontal seat having a forward portion and a rearward portion, means pivotally supporting said forward portion and said rearward portion on said supporting frame for independent relative pivoting of said forward portion and said rearward portion within a vertical plane extending fore and aft of said seat, said forward portion having a forward margin and a downwardly curved rearward margin and said rearward portion having a downwardly curved forward margin and a rearward margin, said downwardly curved margins being spaced apart and defining a depression therebetween which is located substantially closer to said rearward margin of the rearward portion than to said forward margin of the forward portion and tending to receive and locate the pelvic area of a user relative to said seat, said rearward margin of the rearward portion of the seat including a generally upstanding back rest portion, first means reacting between said forward portion and said frame for controlling the angular disposition of said forward portion within said plane, and second means reacting between said rearward portion and said frame for controlling the angular disposition of said rearward portion within said plane, said second means comprising the combination of a gas spring connecting said rearward portion to said frame and a torsional spring also connecting said rearward portion to said frame.

7. A chair as defined in claim 6 including means for independently controlling both the gas spring and the torsion spring to vary the angular disposition of the rearward portion and back rest portion within said plane in accord with the desires of a user.

8. A chair as defined in claim 6 wherein said first means is a gas spring.

9. A chair as defined in claim 6 wherein said means pivotally supporting is located just forwardly of said depression whereby said forward portion is pivotable to swing the forward edge thereof up and down whereas its rearward edge partakes of relatively little corresponding swing and whereby said back rest portion is pivotable to swing back and forth in said plane whereas said rearward portion adjacent said depression partakes of relatively little corresponding swing.

10. A chair as defined in claim 9 wherein said forward and rearward portions swing about a common horizontal axis.

11. A chair as defined in claim 10 wherein said torsion spring comprises a torsion bar lying along said common horizontal axis.

* * * * *